US009302444B1

(12) United States Patent
Valenti, Jr. et al.

(10) Patent No.: US 9,302,444 B1
(45) Date of Patent: Apr. 5, 2016

(54) LABEL FOLDING APPARATUS AND METHODS FOR ITS USE

(71) Applicant: Chicago Tag & Label, Inc., Libertyville, IL (US)

(72) Inventors: F. Paul Valenti, Jr., Barrington, IL (US); Carl Opel, Carol Stream, IL (US); Daniel Hedger, Grayslake, IL (US); John Cammarata, Frankfort, IL (US); Mike English, Frankfort, IL (US)

(73) Assignee: Chicago Tag & Label, Inc., Libertyville, IL (US)

( * ) Notice: Subject to any disclaimer, the term of this patent is extended or adjusted under 35 U.S.C. 154(b) by 0 days.

(21) Appl. No.: 14/212,277

(22) Filed: Mar. 14, 2014

(51) Int. Cl.
*B31B 1/26* (2006.01)
*B31B 1/52* (2006.01)
*B31D 1/02* (2006.01)

(52) U.S. Cl.
CPC ..... *B31D 1/022* (2013.01)

(58) Field of Classification Search
CPC ..... B31B 1/12; B31B 1/26; B31B 1/52; A61L 2/20; B65B 55/10; B65B 55/103; B65B 55/106; B65B 55/027
USPC ..... 493/405, 413, 414, 419, 454, 460, 395, 493/210
See application file for complete search history.

(56) References Cited

U.S. PATENT DOCUMENTS

| | | | | | |
|---|---|---|---|---|---|
| 3,724,341 | A * | 4/1973 | Hook | 493/203 |
| 4,091,595 | A * | 5/1978 | Pelster et al. | 53/417 |
| 4,102,729 | A * | 7/1978 | Annas, Sr. | 156/384 |
| 4,233,798 | A * | 11/1980 | Helding | 53/76 |
| 4,270,909 | A * | 6/1981 | Ireland | 493/245 |
| 4,272,235 | A * | 6/1981 | Barnett | 425/397 |
| 4,290,764 | A * | 9/1981 | Middel | 493/395 |
| 4,300,896 | A * | 11/1981 | Priebs | 493/419 |
| 4,304,621 | A * | 12/1981 | Appoldt et al. | 156/443 |
| 4,347,091 | A * | 8/1982 | Hauck et al. | 156/217 |
| 4,367,117 | A * | 1/1983 | Seaborn | 156/443 |
| 4,402,679 | A * | 9/1983 | Heina | 493/420 |
| 4,432,745 | A * | 2/1984 | Eldridge | 493/10 |
| 4,465,453 | A * | 8/1984 | Turner et al. | 425/384 |
| 4,470,795 | A * | 9/1984 | Prusak | 425/384 |
| 4,475,966 | A * | 10/1984 | Turner et al. | 156/73.1 |
| 4,530,729 | A * | 7/1985 | Fuchs et al. | 156/217 |
| 4,617,081 | A * | 10/1986 | Bleau et al. | 156/443 |
| 4,627,829 | A * | 12/1986 | Brady et al. | 493/189 |
| 4,636,192 | A * | 1/1987 | Vogtlander et al. | 493/451 |
| 4,678,456 | A * | 7/1987 | Nigrelli, Sr. | 493/309 |
| 5,024,644 | A * | 6/1991 | Bunch, III | 493/357 |
| 5,826,408 | A * | 10/1998 | Ford | 53/491 |
| 6,635,005 | B1 * | 10/2003 | Duhamel et al. | 493/417 |
| 7,083,559 | B2 * | 8/2006 | Castello et al. | 493/405 |
| 7,708,679 | B2 * | 5/2010 | Cailloux et al. | 493/401 |
| 2004/0102301 | A1 * | 5/2004 | Szczerba | 493/419 |
| 2007/0049478 | A1 * | 3/2007 | Brunow et al. | 493/414 |
| 2011/0294638 | A1 * | 12/2011 | Tosevski | 493/123 |

* cited by examiner

*Primary Examiner* — Gloria R Weeks
(74) *Attorney, Agent, or Firm* — Ice Miller LLP

(57) ABSTRACT

A label folding apparatus and methods for its use are disclosed. Such a label folding apparatus comprises a label folding assembly and a label holding assembly, and may be used to fold a foldable label placed onto the label holding assembly.

25 Claims, 18 Drawing Sheets

LABEL FOLDING APPARATUS AND METHODS FOR ITS USE

BACKGROUND

Labels are commonly used to secure printed indicia to packages to indicate shipping or other information. In the instance of a shipping use, a separate packing list may be enclosed within a package shipped to the customer containing a purchased item.

There is significant demand for a labeling method that allows automatic printing and application of a lower label and an upper label to a surface. For example, there is significant demand for a labeling method that allows automatic printing and application of a packing list and shipping label to the surface of a sealed carton. Because the carton is sealed prior to packing list generation, it is not efficient to open it to insert a packing list. High volume shipping of such packages requires rapid attachment of a packing list and a shipping label to the package. It is preferred to conceal the information of the packing list until the final recipient receives the shipped package.

Complicated methods have been implemented for application of a lower label and an upper label to a surface. For example, where a packing list and shipping label are to be applied to the surface of a sealed carton, complicated methods have been implemented in which a packing list is applied and adhered atop a carton, using a first roll of labels (packing list labels) and a first label applicator. After the packing list label is applied, an address label is applied and adhered atop the packing list label, to conceal the packing list information, using a second roll of labels (address labels) and a second label applicator. Such methods have many shortcomings. For example, precise timing between the packing list application and the shipping label application is required to properly align the two labels, and to avoid mismatches between the packing list and the shipping label (e.g., where the packing list contains information about goods to be shipped to a first customer and the shipping label contains the address of a different customer. In addition, because two printers and two label applicators, along with related hardware and software, are required to apply a packing list and shipping label in sequence, such methods require significant floor space and investment. For the foregoing reasons, it is desired to provide labeling methods that allows automatic printing and application of a lower label and an upper label to a surface while avoiding the many shortcomings of existing labeling methods.

For the foregoing reasons, it is desired to provide labeling methods that allows automatic printing and application of a packing list label and shipping label to the surface of a sealed carton while avoiding the many shortcomings of existing labeling methods.

SUMMARY

The present disclosure includes disclosure of at least one embodiment of a label folding assembly comprising a label deflector and a label folding device. In a label folding assembly according to at least one embodiment of the present disclosure, a label deflector is mounted to a moveable carriage. In a label folding assembly according to at least one embodiment of the present disclosure, a label deflector comprises an axis, and the axis of the label deflector is not in alignment with a direction of travel of a moveable carriage on which the label deflector is mounted. In a label folding assembly according to at least one embodiment of the present disclosure, a label deflector comprises a curved surface. In a label folding assembly according to at least one embodiment of the present disclosure, a label folding device is mounted to a moveable carriage. In a label folding assembly according to at least one embodiment of the present disclosure, a label folding device comprises a member that extends and retracts.

The present disclosure includes disclosure of at least one embodiment of a label folding apparatus comprising a label folding assembly and a label holding assembly. In a label folding apparatus according to at least one embodiment of the present disclosure, the label folding apparatus comprises a label folding assembly, the label folding assembly comprising a label deflector and a label folding device; and a label holding assembly adjacent the label folding assembly, the label holding assembly comprising a first surface suitable for placing a label thereagainst. In a label folding apparatus according to at least one embodiment of the present disclosure, a label holding assembly comprises at least one aperture through a first surface. In a label folding apparatus according to at least one embodiment of the present disclosure, when a label is placed onto a label holding assembly, the label is held against the label holding assembly by a vacuum force acting through at least one aperture in a first surface of the label holding assembly. In a label folding apparatus according to at least one embodiment of the present disclosure, a first surface of a label holding assembly comprises at least one boundary adjacent a label folding assembly, and when a label is placed onto the label holding assembly, the label extends past the boundary. In a label folding apparatus according to at least one embodiment of the present disclosure, a label deflector is mounted to a moveable carriage. In a label folding apparatus according to at least one embodiment of the present disclosure, a moveable carriage of a label folding assembly is moveable in relation to an adjacent label holding apparatus. In a label folding apparatus according to at least one embodiment of the present disclosure, a moveable carriage of a label folding assembly is moveable between a first position and a second position. In a label folding apparatus according to at least one embodiment of the present disclosure, when a label is placed onto a label holding assembly, movement of a moveable carriage between a first position and a second position causes a label deflector to displace a portion of the label. In a label folding apparatus according to at least one embodiment of the present disclosure, a label folding device is mounted to a moveable carriage. In a label folding apparatus according to at least one embodiment of the present disclosure, when a label is placed onto a label holding assembly, movement of a moveable carriage between a first position and a second position brings a label folding device into alignment with the label. In a label folding apparatus according to at least one embodiment of the present disclosure, a label folding device comprises a member that is moveable between a first configuration and a second configuration. In a label folding apparatus according to at least one embodiment of the present disclosure, when a label is placed onto the label holding assembly, movement of the member between a first configuration and a second configuration folds the label. In a label folding apparatus according to at least one embodiment of the present disclosure, a label holding assembly further comprises a label applicator configured to apply the label to a substrate. In a label folding apparatus according to at least one embodiment of the present disclosure, a label deflector and a label folding device comprise a single mechanism.

The present disclosure includes disclosure of at least one embodiment of a method for folding a foldable label. In at least one embodiment of the present disclosure, a method for folding a foldable label comprising the steps of: placing a foldable label onto a label holding assembly, the label holding assembly comprising a first surface against which the label is held; moving a movable carriage past an end of the label holding assembly, the movable carriage comprising a label deflector and a label folding device, wherein the movement of the movable carriage displaces a portion of the label; aligning the label folding device with the portion of the label that was displaced; and actuating the label folding device, thereby folding the displaced portion of the label.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
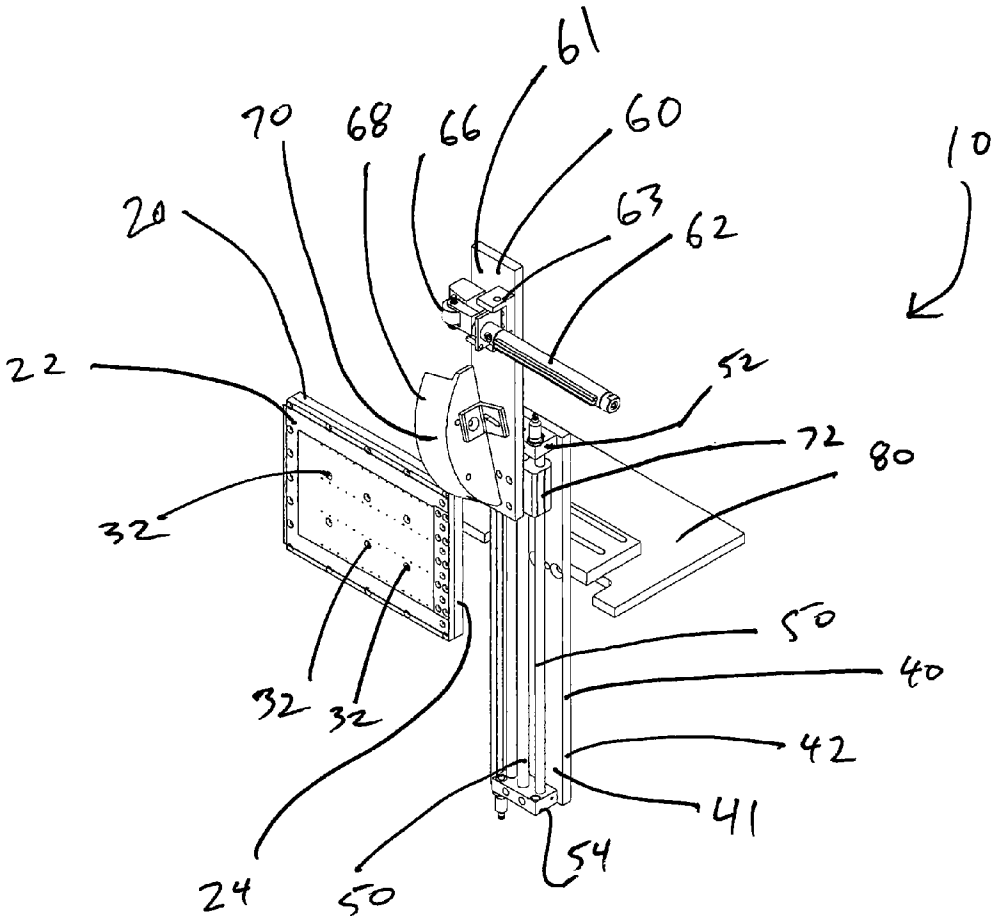
FIG. 1 shows a perspective view of a label folding apparatus according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
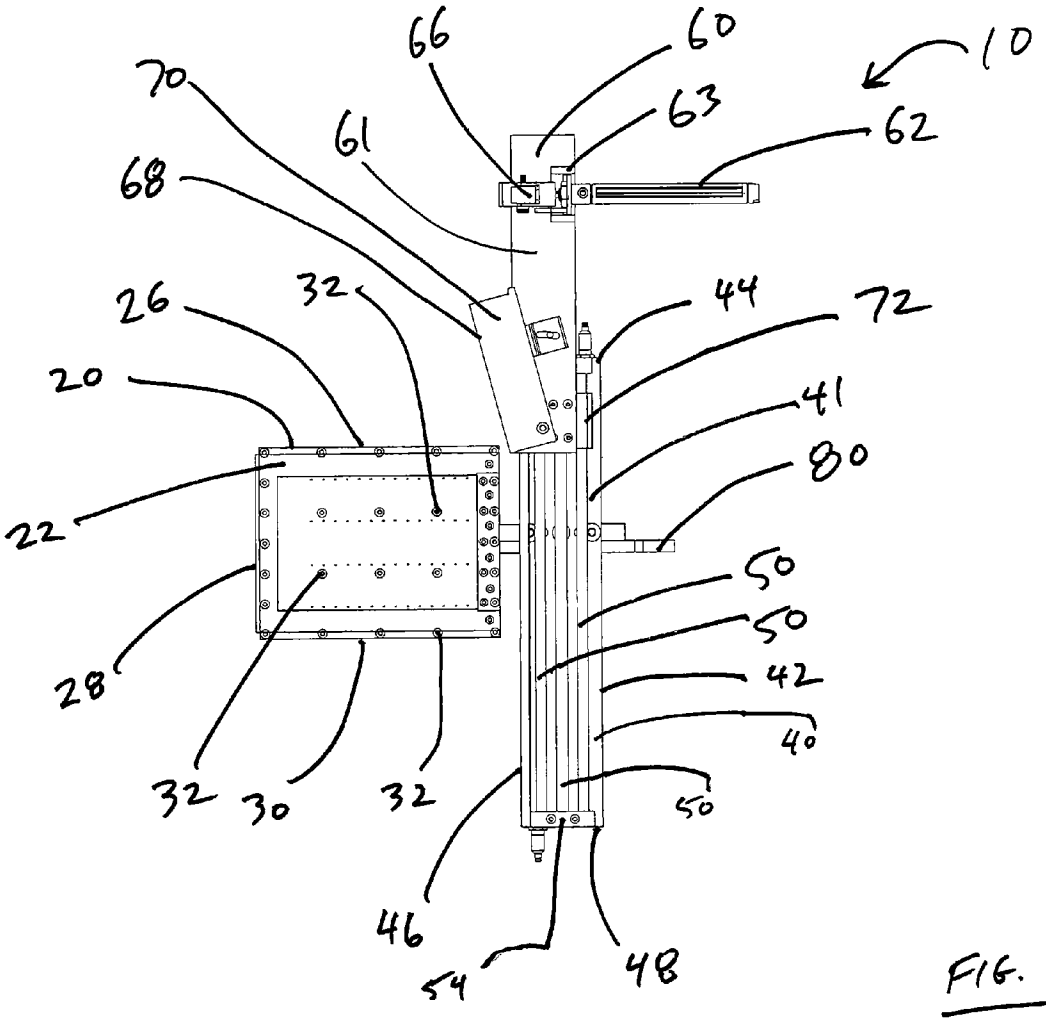
FIG. 2 shows a front view of a label folding apparatus according to at least one embodiment of the present disclosure.
Figure 3:
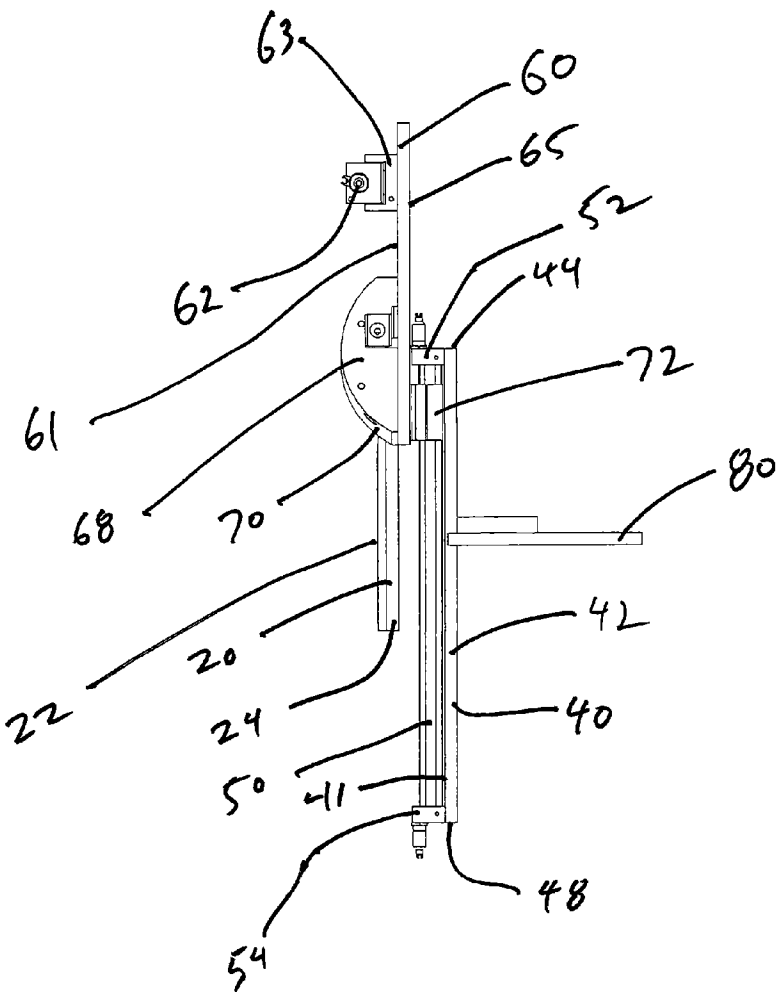
FIG. 3 shows an end view of a label folding apparatus according to at least one embodiment of the present disclosure.

FIG. 1 shows a perspective view of label folding apparatus 10 according to at least one embodiment of the present disclosure. FIG. 2 shows a front view of label apparatus 10 according to at least one embodiment of the present disclosure. FIG. 3 shows an end view of label folding apparatus 10 according to at least one embodiment of the present disclosure.

In the embodiment shown in FIGS. 1-3, label folding apparatus 10 comprises label pad assembly 20, slide support assembly 40, slide assembly 60, and label folding apparatus mounting fixture 80.

In the embodiment shown in FIGS. 1-3, label pad assembly 20 comprises label pad surface 22, first end 24, second end 26, third end 28, and fourth end 30. Label pad assembly 20 further comprises at least one aperture 32 that extends through label pad surface 22. Although label pad assembly 20 is shown in FIGS. 1-3 as a rectangular piece, in other embodiments of label folding apparatus 10 label pad 20 may take on other shapes.

In the embodiment shown in FIGS. 1-3, slide support assembly 40 comprises first surface 41, first side 42, second side 44, third side 46, and fourth side 48. First guide rail mount 52 and second guide rail mount 54 are fastened to first surface 41 of slide mount assembly 40. In the embodiment shown in FIGS. 1-3, first guide rail mount 52 is fastened to first surface 41 near second side 44, and second guide rail mount 54 is fastened to first surface 41 near fourth side 48. At least one guide rail 50 extends between first guide rail mount 52 and second guide rail mount 54. In the embodiment of slide support assembly 40 shown in FIGS. 1-3, three guide rails 50 are deployed. However, in other embodiments of label folding apparatus 10 according to the present disclosure, a greater or lesser number of guide rails 50 may be deployed. In the embodiment shown in FIGS. 1-3, and particularly in FIG. 3, there is a gap between guide rails 50 and first surface 41. However, in other embodiments of label folding apparatus 10 according to the present disclosure, guide rails 50 may be in contact with first surface 41.

In the embodiment shown in FIGS. 1-3, slide assembly 60 comprises first surface 61 and opposing second surface 65. Sheath 62 is affixed to mounting piece 63, which in turn is affixed to first surface 61. Guide 72 is affixed to second surface 65 of slide assembly 60. Guide 72 is slidingly coupled to at least one guide rail 50. Sheath 62 encloses member 64 (not shown in FIGS. 1-3). Roller 66 is affixed to end of member 64. Label deflector 68 is affixed to first surface 61 of slide assembly 63. Label deflector 68 comprises label deflector surface 70, which in the embodiment shown in FIGS. 1-3 is a curved surface. Although label deflector 68 is shown in FIGS. 1-3 with a curved label deflector surface 70, other configurations of label deflector surface 70 are possible and within the scope of the present disclosure. In the embodiment shown in FIGS. 1-3, label deflector 68 is affixed to first surface 61 of slide apparatus 60 such that an axis of label deflector 68 is not in alignment with an axis of guide rails 50. Other configurations of label deflector 68 are possible and within the scope of the present disclosure.

Label folding apparatus mounting fixture 80 comprises a structure to which label pad assembly 20 and slide support assembly 40 are mounted.

Figure 4:
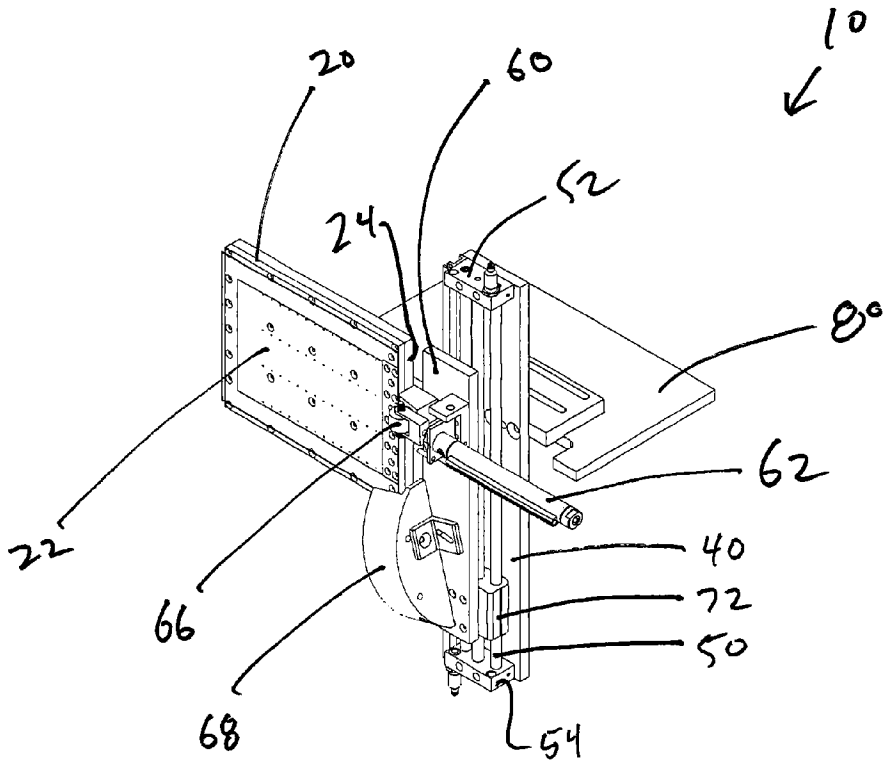
FIG. 4 shows a perspective view of a label folding apparatus according to at least one embodiment of the present disclosure.
Figure 5:
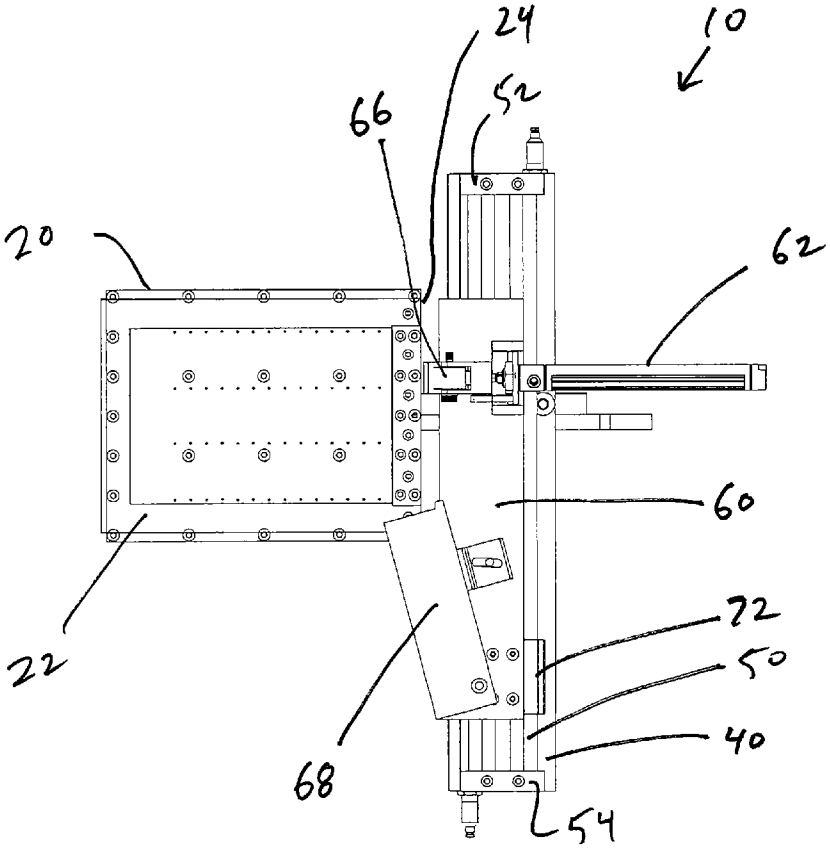
FIG. 5 shows a front view of a label folding apparatus according to at least one embodiment of the present disclosure.
Figure 6:
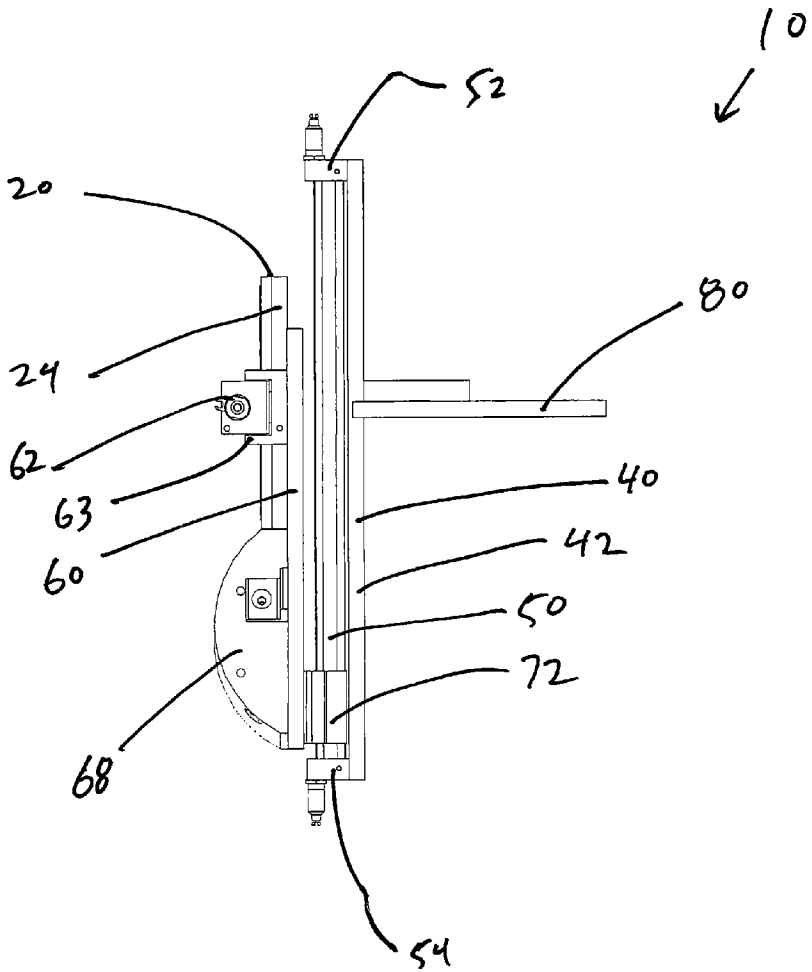
FIG. 6 shows an end view of a label folding apparatus according to at least one embodiment of the present disclosure.

FIGS. 1-3 show label folding apparatus 10 with slide assembly 60 in a first position. In the embodiment shown in FIGS. 1-3, guide 72 of slide assembly 60 is positioned closer to first guide rail mount 52. FIGS. 4-6 show label folding apparatus 10 with slide assembly 60 in a second position. In the embodiment shown in FIGS. 4-6, guide 72 is closer to second guide rail mount 54. FIG. 4 shows a perspective view of label folding apparatus 10 according to at least one embodiment of the present disclosure with slide apparatus 60 in the second position. FIG. 5 shows a front view of label folding apparatus 10 according to at least one embodiment of the present disclosure with slide apparatus 60 in the second position. FIG. 6 shows an end view of label folding apparatus 10 according to at least one embodiment of the present disclosure with slide apparatus 60 in the second position. As slide assembly 60 travels along guide rail 50 between the first position shown in FIGS. 1-3 and the second position shown in FIGS. 4-6, label deflector 68 passes by and/or over first end 24 of label pad assembly 22. When slide assembly 60 is in the second position shown in FIGS. 4-6, roller 66 is aligned with label pad assembly 20. The movement of slide assembly 60 along guide rails 50 may be accomplished by any means that may occur to one skilled in the art after being presented with the disclosure herein, including pneumatic means and electromechanical means.

Figure 7:
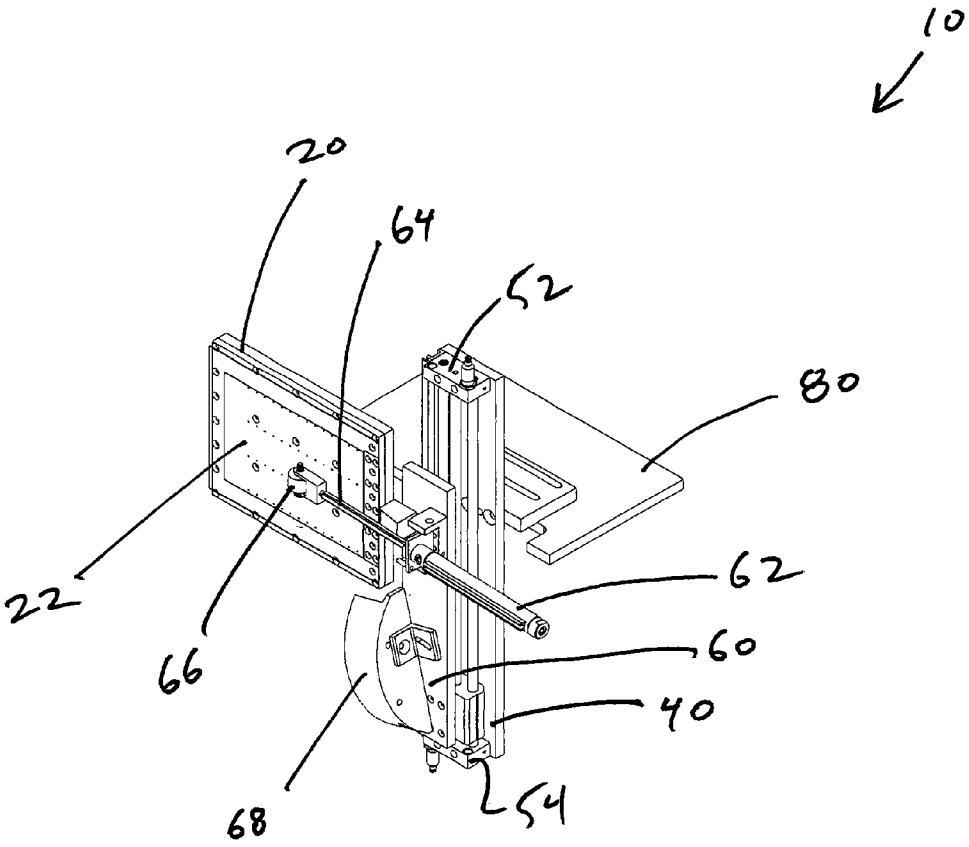
FIG. 7 shows a perspective view of a label folding apparatus according to at least one embodiment of the present disclosure.
Figure 8:
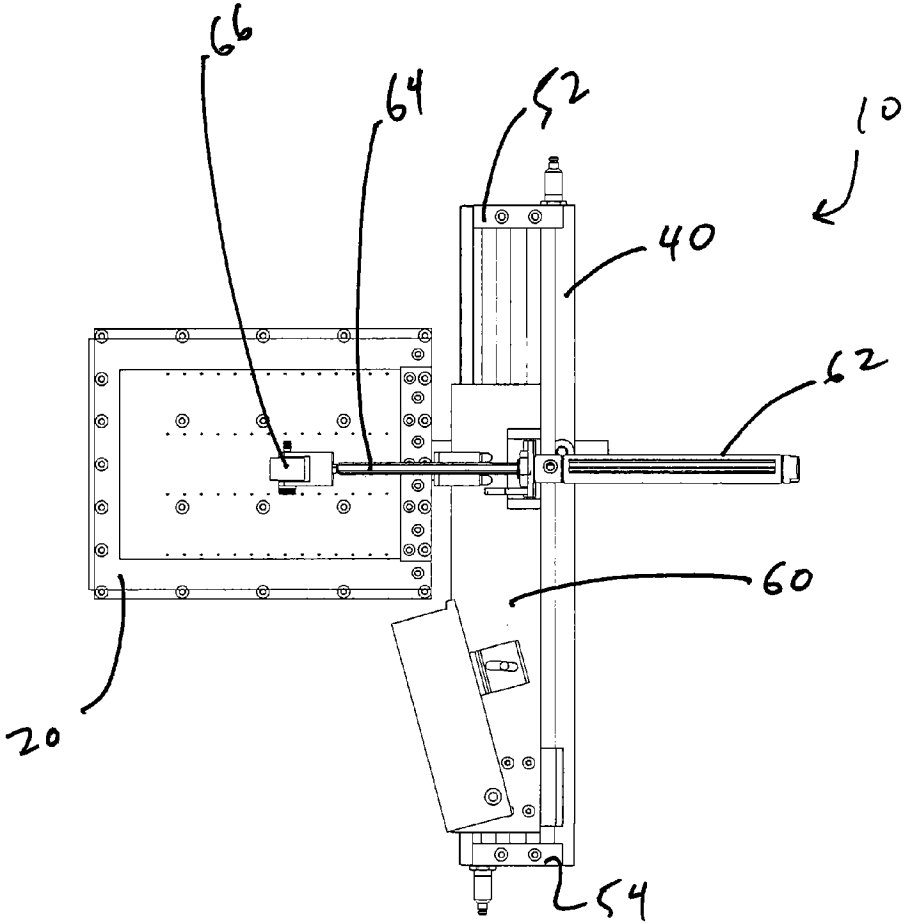
FIG. 8 shows a front view of a label folding apparatus according to at least one embodiment of the present disclosure.

FIG. 7 shows a perspective view of label folding apparatus 10 according to at least one embodiment of the present disclosure, with slide assembly 60 in a second position and member 64 extended from sheath 62. FIG. 8 shows a front view of label folding apparatus 10 according to at least one embodiment of the present disclosure, with slide assembly 60 in a second position and member 64 extended from sheath 62. In the embodiment shown in FIGS. 7-8, when member 64 is extended from sheath 62, roller 66 engages with label pad surface 22. In at least one embodiment of label folding apparatus 10, roller 66 is in contact with label pad surface 22 when member 64 is extended from sheath 62. In at least one embodiment of label folding apparatus 10, roller 66 is not in contact with label pad surface 22 when member 64 is extended from sheath 62. The movement of member 64 may be accomplished by any means that may occur to one skilled in the art after being presented with the disclosure herein, including pneumatic means and electromechanical means.

Figure 9:
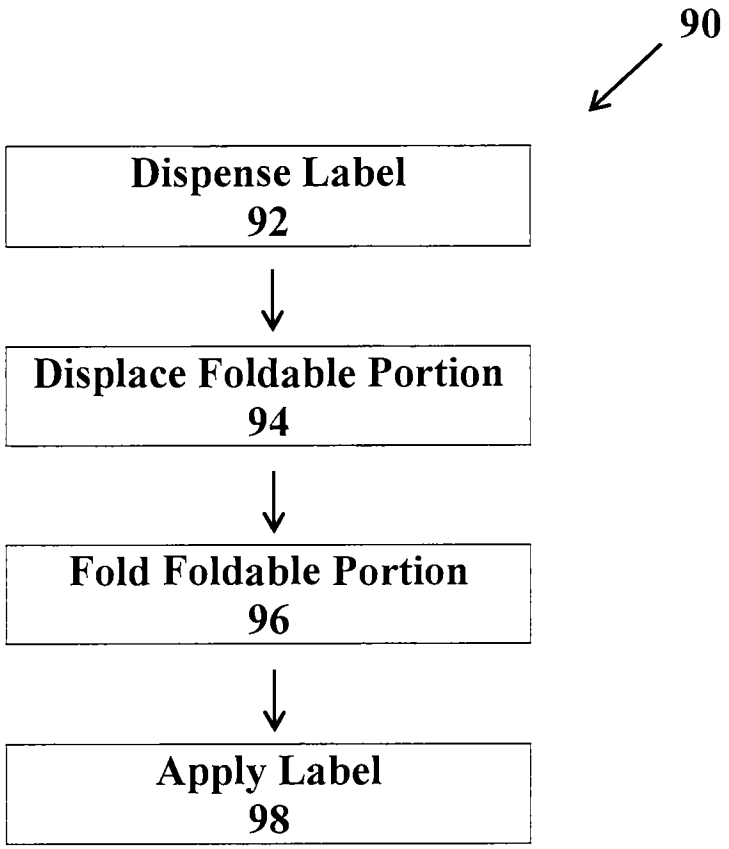
FIG. 9 shows a flowchart illustrating the use of label folding apparatus according to at least one embodiment of the present disclosure.

FIG. 9 shows a flowchart illustrating the operation of a label folding apparatus according to at least one embodiment of the present disclosure. As shown in step 92 of FIG. 9, an at least partially adhesive-backed label is dispensed onto a label folding apparatus. For example, a label assembly comprising release coated liner with one or more at least partially adhesive-backed labels removably adhered thereto may be routed through a dispensing mechanism (not shown) causing an at least partially adhesive-backed label to be separated from the release coated liner and dispensed onto a label folding apparatus with the adhesive exposed. In at least one embodiment, such an at least partially adhesive-backed label comprises a covering portion and a foldable portion. In at least one such embodiment, the covering portion comprises a surface area larger than the surface area of the foldable portion. In step 94 of FIG. 9, the foldable portion of the at least partially adhesive-backed label is displaced by the label folding apparatus. In at least one embodiment of the present disclosure, a label folding apparatus comprises a label deflector on a moveable carriage. In such an embodiment, when moved past the at least partially adhesive-backed label, the label deflector on the moveable carriage displaces at least a portion of the at least partially adhesive-backed label. In at least one embodiment of the present disclosure, the label folding apparatus comprises a stationary label deflector. In such an embodiment, the step of dispensing an at least partially adhesive-backed label onto a label folding apparatus forces the label against or over the stationary label deflector, thereby displacing at least a portion of the at least partially adhesive-backed label. In at least one embodiment of the present disclosure, the label folding apparatus comprises a forced-air label deflector. In such an embodiment, after an at least partially adhesive-backed label is dispensed onto a label folding apparatus, air is blown against the at least partially adhesive-backed label, thereby displacing at least a portion of the at least partially adhesive-backed label. In step 96 of FIG. 9, the foldable portion of the at least partially adhesive-backed label is folded, so that the adhesive of the foldable portion is brought into contact with the adhesive of the covering portion. In step 98 of FIG. 9, the label is applied to a substrate, such as a container or package.

Figure 10:
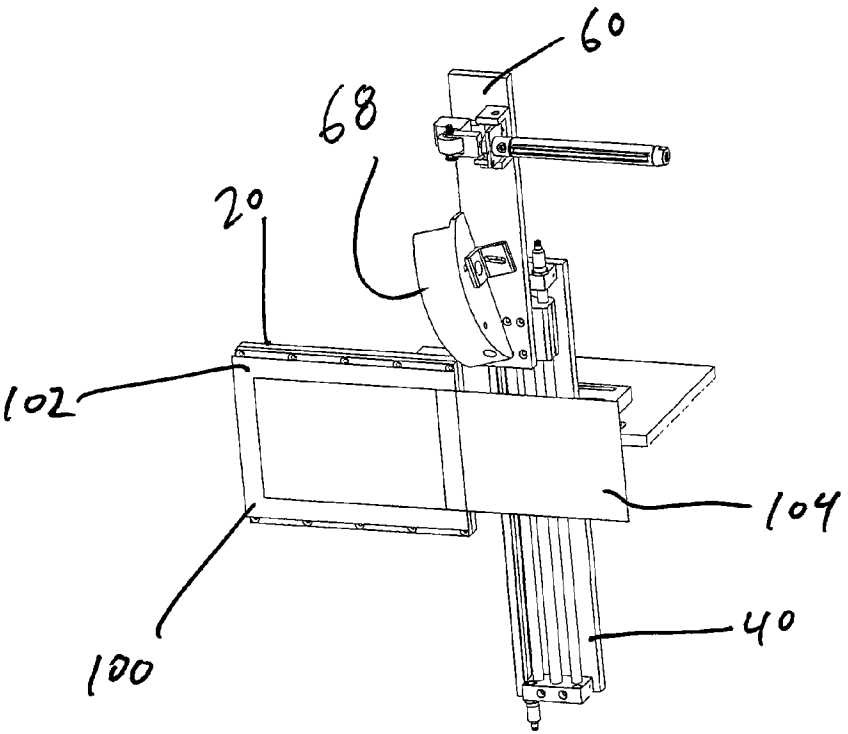
FIG. 10 shows a perspective view of a label folding apparatus according to at least one embodiment of the present disclosure.
Figure 11:
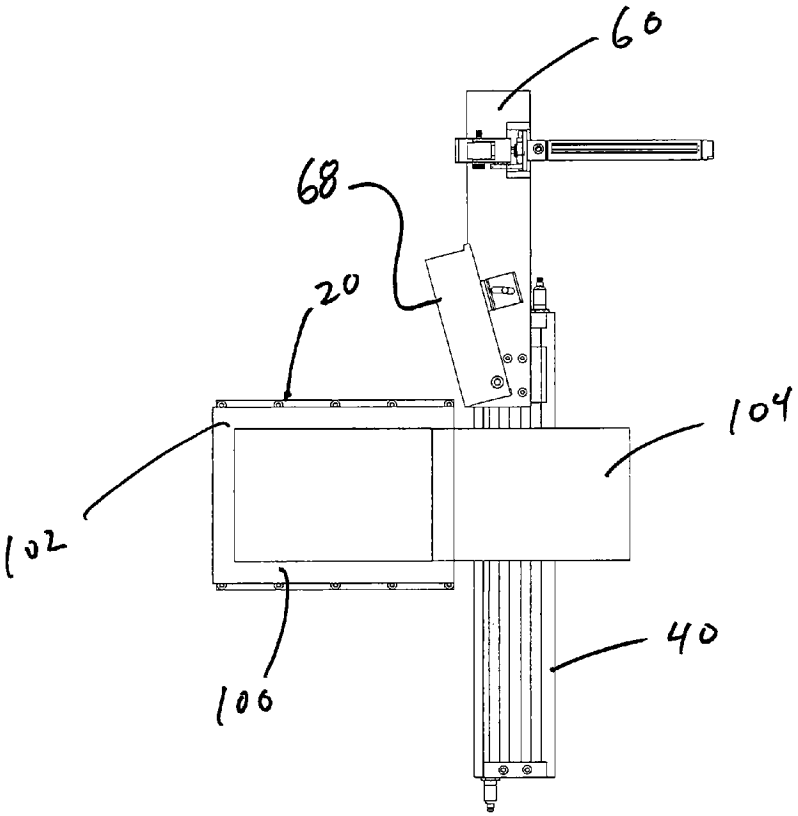
FIG. 11 shows a front view of a label folding apparatus according to at least one embodiment of the present disclosure.

FIGS. 10-11 shows a perspective view of label folding apparatus 10 according to at least one embodiment of the present disclosure with label 100 dispensed thereon. In the embodiment shown in FIGS. 10-11, slide assembly 60 is in the first position as shown in FIGS. 1-3. In the embodiment shown in FIGS. 10-11, label 100 comprises covering portion 102 and foldable portion 104. In at least one such embodiment, covering portion 102 comprises a surface area larger than the surface area of foldable portion 104. As shown in FIGS. 10-11, at least a portion of covering portion 102 and foldable portion 104 comprise an adhesive backing. Label 100 is dispensed onto label pad assembly 20 so that the adhesive backing of covering portion 102 and foldable portion 104 faces away from label pad surface 22. In the embodiment shown in FIGS. 10-11, label 100 is larger than label pad surface 22, so at least a portion of foldable portion 104 extends beyond first end 24 and into the path of label deflector 68. Covering portion 102 is held against label pad surface 22 by a vacuum engaged against covering portion 102 through apertures 32.

Figure 12:
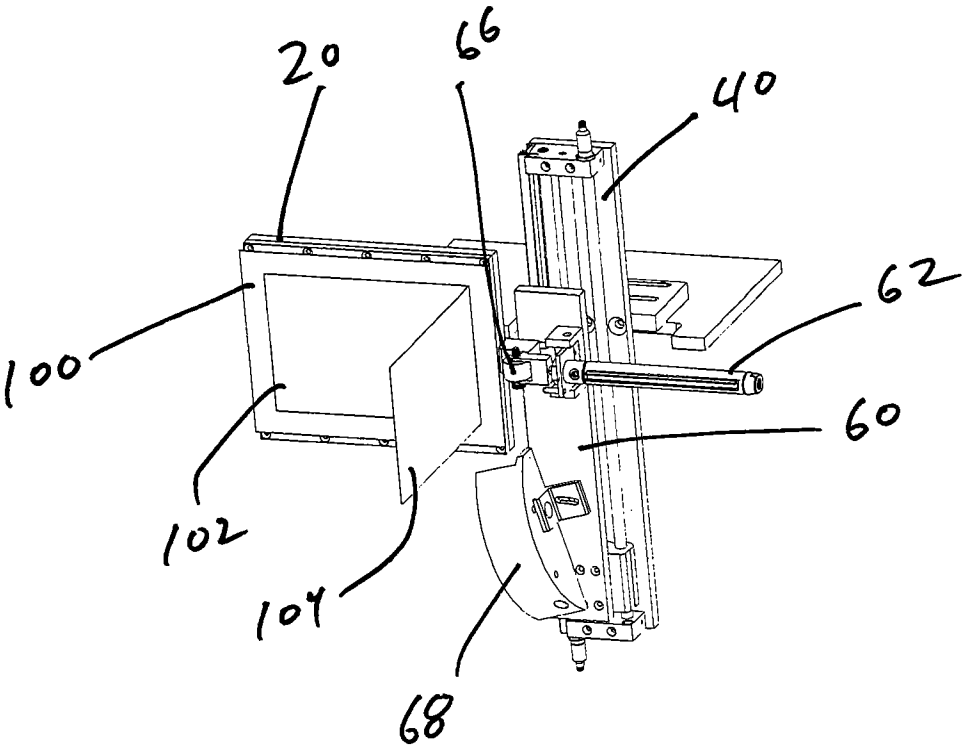
FIG. 12 shows a perspective view of a label folding apparatus according to at least one embodiment of the present disclosure.

FIG. 12 shows label folding apparatus 10 with label 100 dispensed thereon. In the embodiment shown in FIG. 12, slide assembly 60 has traveled from the first position shown in FIGS. 1-3 to the second position shown in FIGS. 4-6. When slide assembly 60 travels from the first position to the second position, label deflector 68 engages foldable portion 104 of label 100, thereby displacing foldable portion 104 of label 100 from its planar alignment with covering portion 102 of label 100. In an embodiment of the present disclosure where label deflector 68 comprises a curved label deflector surface such as curved label deflector surface 70, label deflector 68 progressively engages foldable portion 104 of label 100 as slide assembly 60 travels from the first position to the second position, thereby reducing the risk that label 100 will be torn as label deflector 68 engages foldable portion 104 of label 100. In an embodiment of the present disclosure where label deflector 68 is affixed to first surface 61 of slide apparatus 60 at an angle to an axis of guide rails 50, label deflector 68 progressively engages foldable portion 104 of label 100 as slide assembly 60 travels from the first position to the second position, thereby reducing the risk that label 100 will be torn as label deflector 68 engages foldable portion 104 of label 100. In at least one embodiment of label 100, there may be one or more lines of weakness between covering portion 102 and foldable portion 104 so that displacement of foldable portion 104 by label deflector 68 is facilitated.

Figure 13:
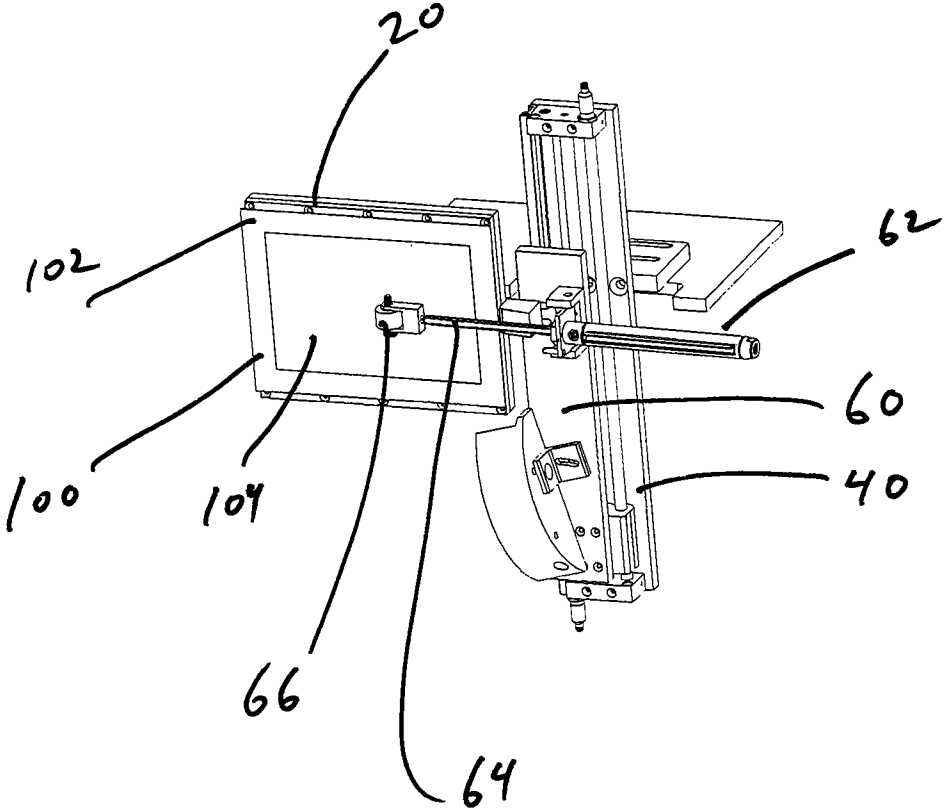
FIG. 13 shows a perspective view of a label folding apparatus according to at least one embodiment of the present disclosure.
Figure 14:
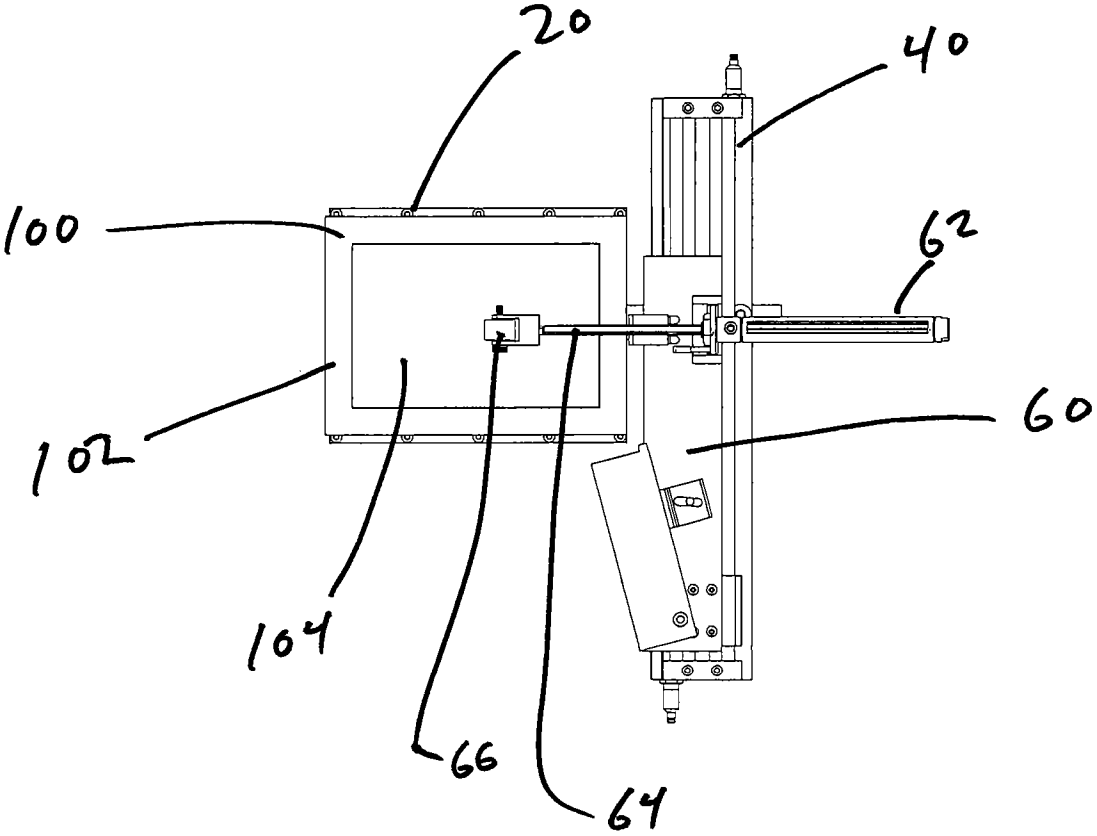
FIG. 14 shows a front view of a label folding apparatus according to at least one embodiment of the present disclosure.

FIGS. 13-14 show label folding apparatus 10 with label 100 dispensed thereon according to at least embodiment of the present disclosure. In the embodiment shown in FIGS. 13-14, member 64 is extended from sheath 62. Roller 66 thereby contacts foldable portion 104 of label 100, folding foldable portion 104 on label 100 against covering portion 102 of label 100. The adhesive backing on a least a part of covering portion 102 of label 100 and/or foldable portion 104 of label 100 causes foldable portion 104 to be adhered against covering portion 102. In at least one embodiment of the present disclosure, a label folding device (such as, for example, a sheath, member, and roller device like sheath 62, member 64, and roller 66) is not affixed to a moveable carriage such as, for example, slide assembly 60. In such an embodiment, such a label folding device is in a fixed position in alignment with label pad assembly 20. In this fixed position, such a label folding device is aligned with the eventual position of a label that is dispensed onto label pad assembly 20. After a label is dispensed onto such a label pad assembly and portion of such a label has been displaced by a label deflector, such a label folding device then is actuated, thereby folding the label.

Figure 15:
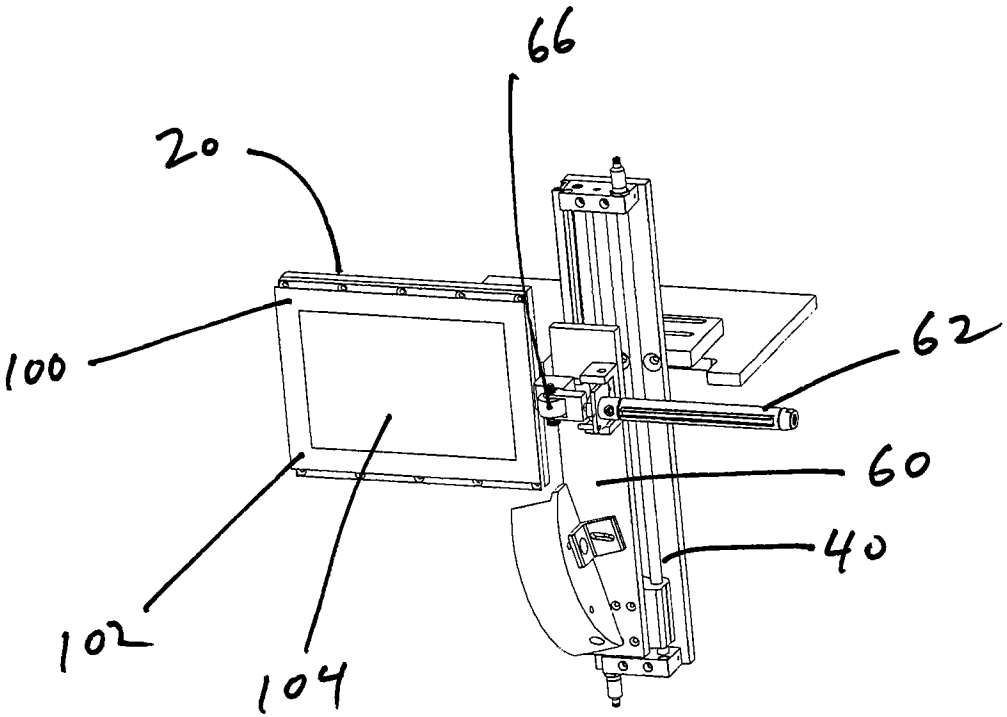
FIG. 15 shows a perspective view of a label folding apparatus according to at least one embodiment of the present disclosure.
Figure 16:
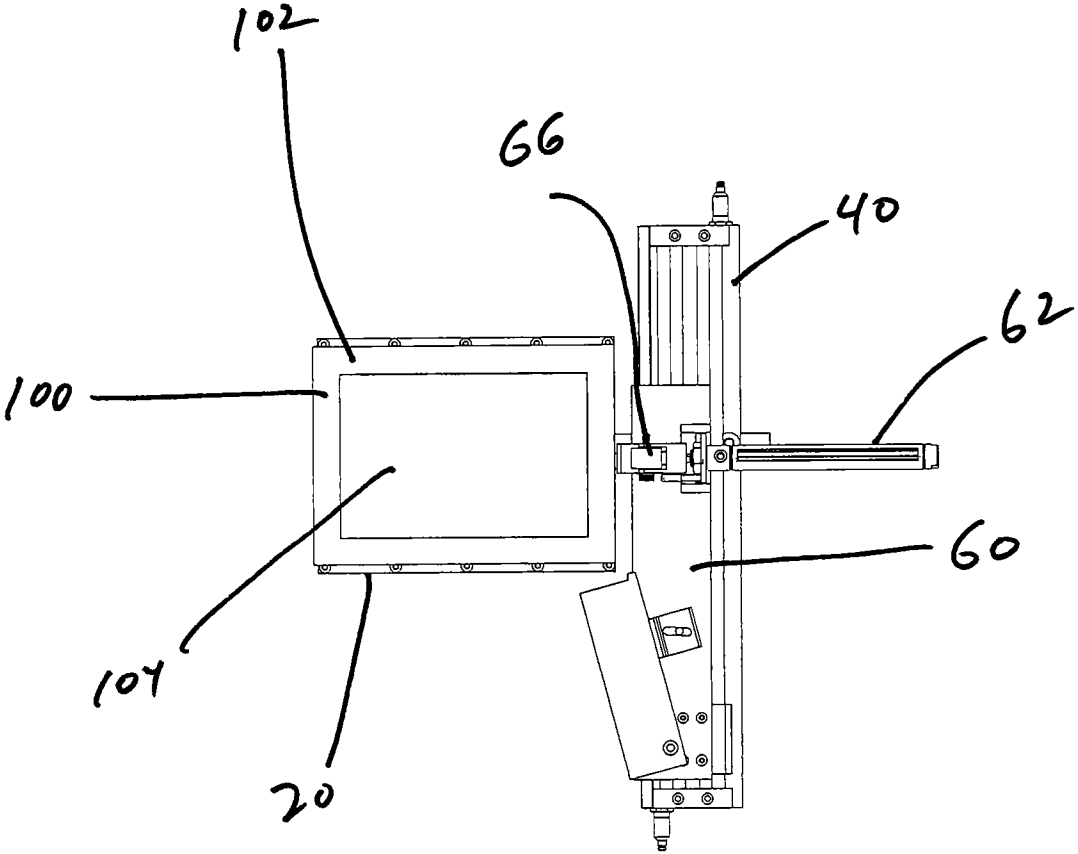
FIG. 16 shows a front view of a label folding apparatus according to at least one embodiment of the present disclosure.

FIGS. 15-16 show label folding apparatus 10 according to at least one embodiment of the present disclosure with label 100 dispensed thereon. In the embodiment shown in FIGS. 15-16, member 64 is retracted into sheath 62, and roller 66 is brought out of engagement with foldable portion 104.

Figure 17:
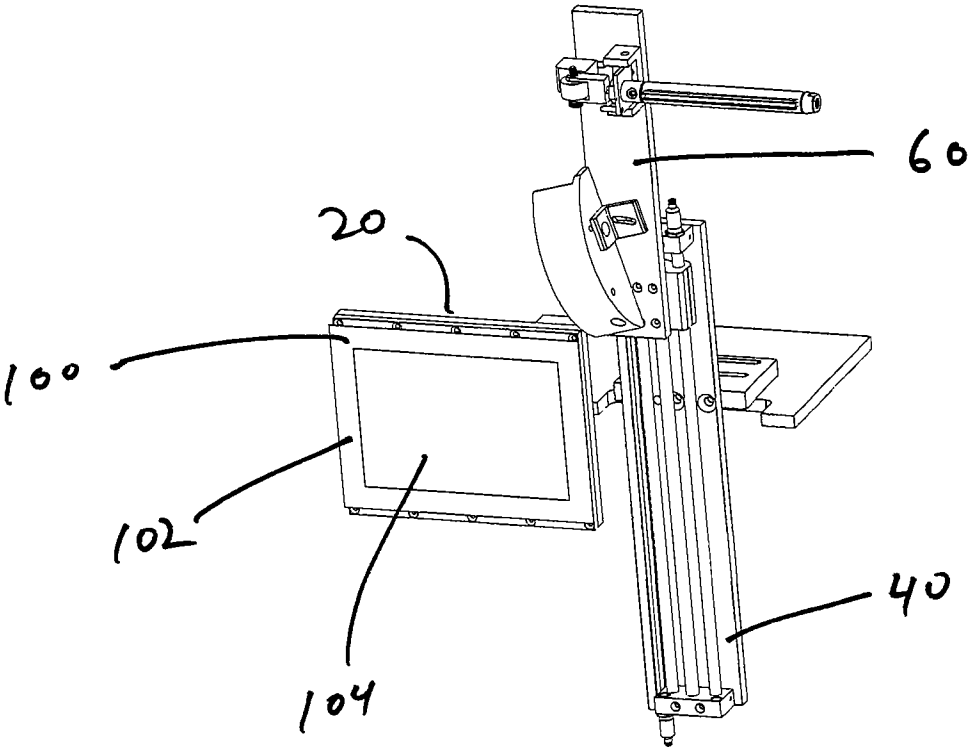
FIG. 17 shows a perspective view of a label folding apparatus according to at least one embodiment of the present disclosure.
Figure 18:
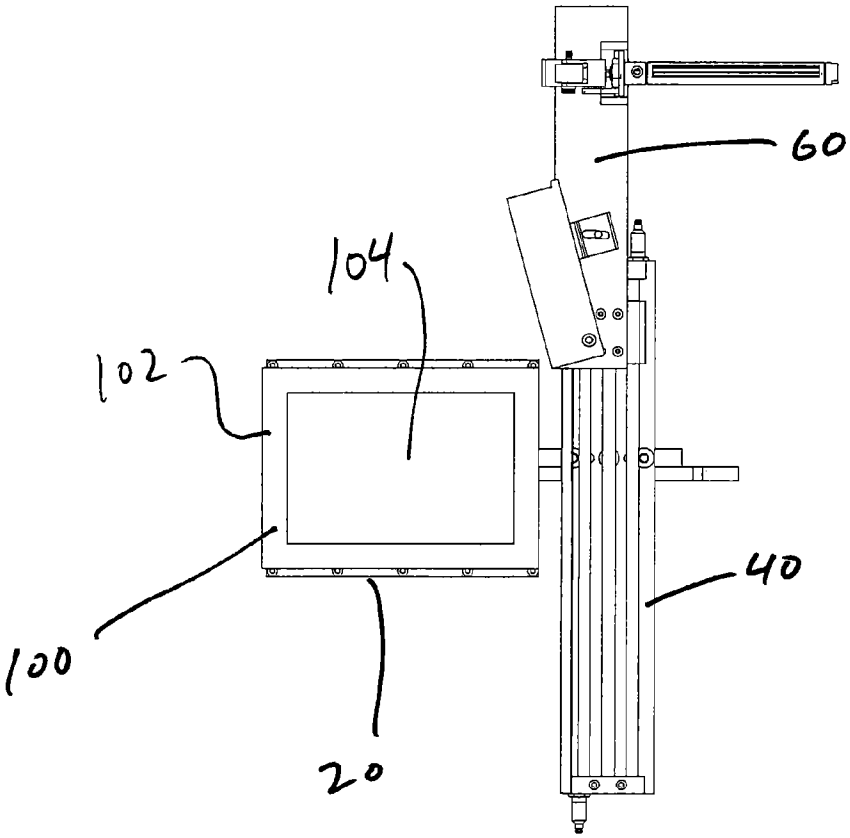
FIG. 18 shows a front view of a label folding apparatus according to at least one embodiment of the present disclosure.

FIGS. 17-18 show label folding apparatus 10 according to at least one embodiment of the present disclosure with label 100 dispensed thereon. In the embodiment shown in FIGS. 17-18, slide assembly 60 is returned to the first position shown in FIGS. 1-3. Label 100 then may be applied to a substrate, such as the surface of a container or the surface of a package. In at least one embodiment, label 100 may be removed from label pad surface 202 manually and manually applied to such a surface. In at least one embodiment, label pad assembly 20 comprises a label applicator mechanism. In such an embodiment, label pad assembly 20 with label 100 attached thereto may be moved into alignment with such a surface so that the exposed adhesive on label 100 will be brought into contact with such a surface.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. A label folding apparatus comprising:

a label holding assembly, said label holding assembly comprising a first surface suitable for placing a label thereagainst, said label comprising a first portion and second portion; and a label folding assembly adjacent said label holding assembly, said label folding assembly comprising a label deflector and a label folding device attached thereto, said label deflector configured to temporarily engage with and then disengage from said second portion of said label, said label folding device configured to fold said second portion of said label onto said first portion of said label after said label deflector has disengaged from said second portion of said label.

2. The label folding apparatus of claim 1, wherein said label holding assembly further comprises at least one aperture through said first surface.

3. The label folding apparatus of claim 2, wherein when a label is placed onto said label holding assembly, said label is held against said label holding assembly by a vacuum force acting through said at least one aperture.

4. The label folding apparatus of claim 1, wherein said first surface comprises at least one boundary adjacent said label folding assembly, and wherein when a label is placed onto said label holding assembly, said second portion of said label extends past said boundary.

5. The label folding apparatus of claim 1, further comprising:

a moveable carriage to which said label deflector and said label folding device are attached, said moveable carriage being moveable in relation to said label holding assembly.

6. The label folding apparatus of claim 5, wherein said moveable carriage is moveable along a path between a first position and a second position.

7. The label folding apparatus of claim 6, wherein said second portion of said label is in said path, and wherein when said moveable carriage moves along said path said label deflector is brought into temporary contact with said label.

8. The label folding apparatus of claim 5, wherein said moveable carriage is moveable between a first position and a second position, and wherein when said label is placed onto said label holding assembly, movement of said moveable carriage between said first position and said second position causes said label deflector to temporarily engage with and then disengage from said second portion of said label.

9. The label folding apparatus of claim 5, wherein said moveable carriage is moveable in relation to said label holding assembly while said label deflector remains stationary in relation to said moveable carriage.

10. The label folding apparatus of claim 5, wherein said second portion of said label extends into a path of travel of said moveable carriage.

11. The label folding apparatus of claim 1, further comprising:

a moveable carriage to which said label deflector and said label folding device are attached, said moveable carriage being is moveable between a first position and a second position, wherein when a label is placed onto said label holding assembly, movement of said moveable carriage to said second position brings said label folding device into alignment with said label.

12. The label folding apparatus of claim 1, wherein said label folding device comprises an elongated member, said elongated member being moveable between a first retracted configuration and a second extended configuration.

13. The label folding apparatus of claim 12, wherein when a label is placed onto said label holding assembly, movement of said elongated member between said first retracted configuration and said second extended configuration folds said second portion of said label onto said first portion of said label.

14. The label folding apparatus of claim 12, further comprising:

a roller attached to one end of said elongated member.

15. The label folding apparatus of claim 14, wherein when a label is placed onto said label holding assembly, movement of said elongated member between said first retracted configuration and said second extended configuration brings said roller into contact with said second portion of said label thereby folding said second portion of said label onto said first portion of said label.

16. The label folding apparatus of claim 1, wherein said label holding assembly further comprises a label applicator configured to apply said label to a substrate.

17. The label folding apparatus of claim 1, wherein said label deflector and said label folding device comprise a single mechanism.

18. The label folding apparatus of claim 1, further comprising:

a moveable carriage to which said label deflector and said label folding device are attached, said moveable carriage being moveable between a first position and a second position, and wherein when a label is placed onto said label holding assembly, movement of said moveable carriage between said first position and said second position causes said label deflector to engage with and then disengage from said second portion of said label and then brings said label folding device into alignment with said label.

19. A label folding apparatus comprising:

a label folding assembly, said label folding assembly comprising a moveable carriage with a label deflector attached thereto; and a label holding assembly adjacent said label folding assembly, said label holding assembly comprising a first flat surface suitable for placing a label thereagainst, wherein said moveable carriage is moveable in relation to said label holding assembly while said label deflector remains stationary in relation to said moveable carriage, and wherein movement of said moveable carriage causes said label deflector to be brought into contact with said label.

20. The label folding apparatus of claim 19, wherein said moveable carriage is moveable between a first position and a second position, and wherein when a label is placed onto said label holding assembly, movement of said moveable carriage between said first position and said second position causes said label deflector to temporarily engage with and then disengage from said label, thereby permanently displacing at least a portion of said label.

21. A label folding apparatus comprising:

a label folding assembly, said label folding assembly comprising a moveable carriage with a label folding device attached thereto, said label folding device comprising an elongated member, said elongated member being moveable between a first retracted configuration and a second extended configuration; and a label holding assembly adjacent said label folding assembly, said label holding assembly comprising a first flat surface suitable for placing a label thereagainst, wherein said moveable carriage is moveable in relation to said label holding assembly while said label folding device remains stationary in relation to said moveable carriage.

22. The label folding apparatus of claim 21, wherein said moveable carriage is moveable between a first position where said label folding device is not aligned with said label holding assembly and a second position where said label folding device is aligned with said label holding assembly.

23. The label folding apparatus of claim 21, wherein when a label is placed onto said label holding assembly, movement of said elongated member between said first retracted configuration and said second extended configuration folds said label.

24. The label folding apparatus of claim 21, further comprising:

a roller attached to one end of said elongated member.

25. The label folding apparatus of claim 24, wherein when a label is placed onto said label holding assembly, movement of said elongated member between said first retracted configuration and said second extended configuration brings said roller into contact with said second portion of said label thereby folding said second portion of said label onto said first portion of said label.

* * * * *